United States Patent [19]

Suzuki

[11] Patent Number: 5,015,214

[45] Date of Patent: May 14, 1991

[54] COIN FEED-IN APPARATUS FOR COIN HANDLING MACHINE

[75] Inventor: Mikio Suzuki, Sakai, Japan

[73] Assignee: Laurel Bank Machines Co., Ltd., Tokyo, Japan

[21] Appl. No.: 402,640

[22] Filed: Sep. 5, 1989

[30] Foreign Application Priority Data

Sep. 6, 1988 [JP] Japan ..... 63-117122[U]
Aug. 21, 1989 [JP] Japan ..... 1-214703

[51] Int. Cl.[5] ..... G07D 1/00
[52] U.S. Cl. ..... 453/56; 453/57
[58] Field of Search ..... 453/7, 11, 12, 30, 32, 453/56, 57

[56] References Cited

U.S. PATENT DOCUMENTS

| | | | |
|---|---|---|---|
| 3,376,970 | 4/1968 | Roseberg | 453/30 X |
| 3,565,086 | 2/1971 | Zimmermann | 453/11 |
| 3,795,253 | 3/1974 | Hatanaka et al. | 453/57 |
| 4,772,244 | 9/1988 | Ozeki | 453/57 |
| 4,800,997 | 1/1989 | Ozeki et al. | 453/32 X |

FOREIGN PATENT DOCUMENTS

| | | | |
|---|---|---|---|
| 2838746 | 3/1980 | Fed. Rep. of Germany | 453/11 |
| 62-112781 | 7/1987 | Japan . | |

*Primary Examiner*—F. J. Bartuska

*Attorney, Agent, or Firm*—Fleit, Jacobson, Cohn, Price, Holman & Stern

[57] ABSTRACT

A coin feed-in apparatus for a coin handling machine including a rotatable disk for receiving coins, guide ring having an opening for guiding the coins, which were received by the rotatable disk and moved toward the periphery of the rotatable disk by centrifugal force produced by the rotation of the rotatable disk, by the inner circumference thereof, a coin passage communicating with the opening and having a pair of first and second guide rails and a transporting belt for transporting the coins, the coins being transported along the first guide rail disposed on the side of the rotatable disk, a discriminator for discriminating the denomination, genuineness and the like of coins, a counter for counting the value of deposited coins, coin sorting openings for sorting the coins in accordance with their denominations, the respective discriminator, the counter and the coin sorting openings being arranged along the first guide rail, and a guide roller rotatable and disposed upstream of the first guide rail, the guide ring being arranged so that the inner circumference thereof is positioned inside of the periphery of the rotatable disk and the first guide rail being arranged so as to extend onto the rotatable disk. In this coin feed-in apparatus, it is possible to prevent erroneous discrimination of coins, erroneous counting of coin value and erroneous sorting of coins.

5 Claims, 3 Drawing Sheets

COIN FEED-IN APPARATUS FOR COIN HANDLING MACHINE

BACKGROUND OF THE INVENTION

The present invention relates to a coin feed-in apparatus for feeding coins into a coin passage for a coin handling machine having a rotatable disk for receiving coins, in which coins are fed to the coin passage one by one by centrifugal force produced by the rotation of the rotatable disk and the discrimination of their denominations, genuineness and the like, the sorting of coins in accordance with their denominations and the counting of their value are carried out.

DESCRIPTION OF THE PRIOR ART

There is known a coin handling machine having a rotatable disk for receiving coins, in which coins are fed to the coin passage one by one by centrifugal force produced by the rotation of the rotatable disk to be fed along one of a pair of guide rails and in which a discriminating means, a counting means and a plurality of sorting openings for sorting coins in accordance with their denominations based upon their diameters are provided, whereby the discrimination of their denominations, genuineness and the like, the sorting of coins in accordance with their denominations and the counting of the their value are carried out.

For making this kind of coin handling machines compact, it is preferable to feed coins along the inner guide rail, that is, the guide rail disposed on the side of the rotatable disk of the pair of guide rails. Japanese Laid-Open Utility Model Application No. 59(1984)-165064 proposes a coin feed-in apparatus for a coin handling machine which feeds coins along the inner guide rail of the pair of guide rails. This coin introducing apparatus comprises a guide ring disposed so that its inner circumference for guiding coins is disposed outside of the periphery of the rotatable disk and having an opening for feeding out coins to a coin passage, a pair of guide rails for guiding coins being fed in the coin passage, a transporting belt disposed above the coin passage for pressing coins onto the upper face of the coin passage and feeding them along the inner guide rail, and a guide roller disposed upstream of the inner guide rail and rotatable so as to prevent coins from jamming and feed them into the coin passage.

FIG. 3 shows a plan view of this prior art coin feed-in apparatus. Referring to FIG. 3, coins C are deposited through a coin deposit opening (not shown) to the rotatable disk 20 and fed to the coin passage 23 through the opening 22 formed in the guide ring 21 by centrifugal force produced by the rotation of the rotatable disk, while being guided by the inner circumference of the guide ring 21. The pair of guide rails 24, 25 are provided in the coin passage 23 and coins C are fed along the inner guide rail 24 in the coin passage 23. At the opening 22 of the guide ring 21, the transporting belt 26 is provided so as to be engaged with pulleys 27, 28 and feeds coins C along the inner guide rail 24, while pressing coins C onto the upper face of the coin passage 23. Further, the rotatable guide roller 29 is provided upstream of the inner guide rail 24 so that coins C fed from the rotatable disk 20 to the coin passage 23 are smoothly fed into the coin passage 23 without jamming.

In the thus constituted prior art coin feed-in apparatus, a coin C fed from the rotatable disk 20 into the coin passage 23 first comes into contact with the guide roller 29. However, since the guide roller 29 is not rotated, the coin C is inevitably temporarily stopped when it comes into contact with the guide roller 29 and the following coin C often collides with it. Therefore, there is a risk of the preceding coin C and/or the following coin C being pushed away from the inner guide rail 24, along which they should be fed, toward the outer guide rail 25. As described above, although the transporting belt 26 is driven so as to feed the coins along the inner guide rail 24, in the case of such deviation occurring, it is difficult for the transporting belt 26 to return the coins to their desired transporting path and feed the coins along the inner guide rail 24 and is also difficult to carry out the discrimination, counting and sorting of coins by the discriminating means, the counting means and the sorting openings arranged along the inner guide rail 24. Particularly, in the case where the difference in diameter between the largest diameter coins and the smallest diameter coins is great, or where the difference in thickness between the thickest coins and the thinnest coins is great, the smallest coins or the thinnest coins tend to deviate from their desired transporting path by the collision and the problem becomes serious.

SUMMARY OF THE INVENTION

It is therefore an object of the present invention to provide a coin feed-in apparatus for a coin handling machine capable of preventing coins from being erroneously discriminated, the value of coins from being erroneously counted and coins from being erroneously sorted.

According to the present invention, the above and other objects are accomplished by a coin feed-in apparatus for a coin handling machine comprising a rotatable disk for receiving coins, guide means having an opening for guiding the coins, which were received by the rotatable disk and moved toward the periphery of the rotatable disk by centrifugal force produced by the rotation of the rotatable disk, by the inner circumference thereof, a coin passage communicating with said opening and having a pair of first and second guide rail means and transporting belt means for transporting the coins, the coins being transported along the first guide rail means disposed on the side of the rotatable disk of the pair of guide rail means, discriminating means for discriminating the denomination, genuineness and the like of coins, counting means for counting the value of deposited coins, sorting means for sorting the coins in accordance with their denominations, the respective discriminating means, the counting means and the sorting means being arranged along said first guide rail means disposed on the side of the rotatable disk, and guide roller means rotatable and disposed upstream of said first guide rail means, said guide means being arranged so that said inner circumference thereof is positioned inside of the periphery of said rotatable disk and said first guide rail means being arranged so as to extend onto said rotatable disk.

In a preferred aspect of the present invention, said transporting belt means is further arranged so as to extend upstream of the end of the guide means disposed upstream of said opening with respect to the rotating direction of the rotatable disk and facing said opening.

The above and other objects and features of the present invention will become apparent from the following description made with reference to the accompanying drawings.

DESCRIPTION OF THE PREFERRED EMBODIMENTS

Figure 1:
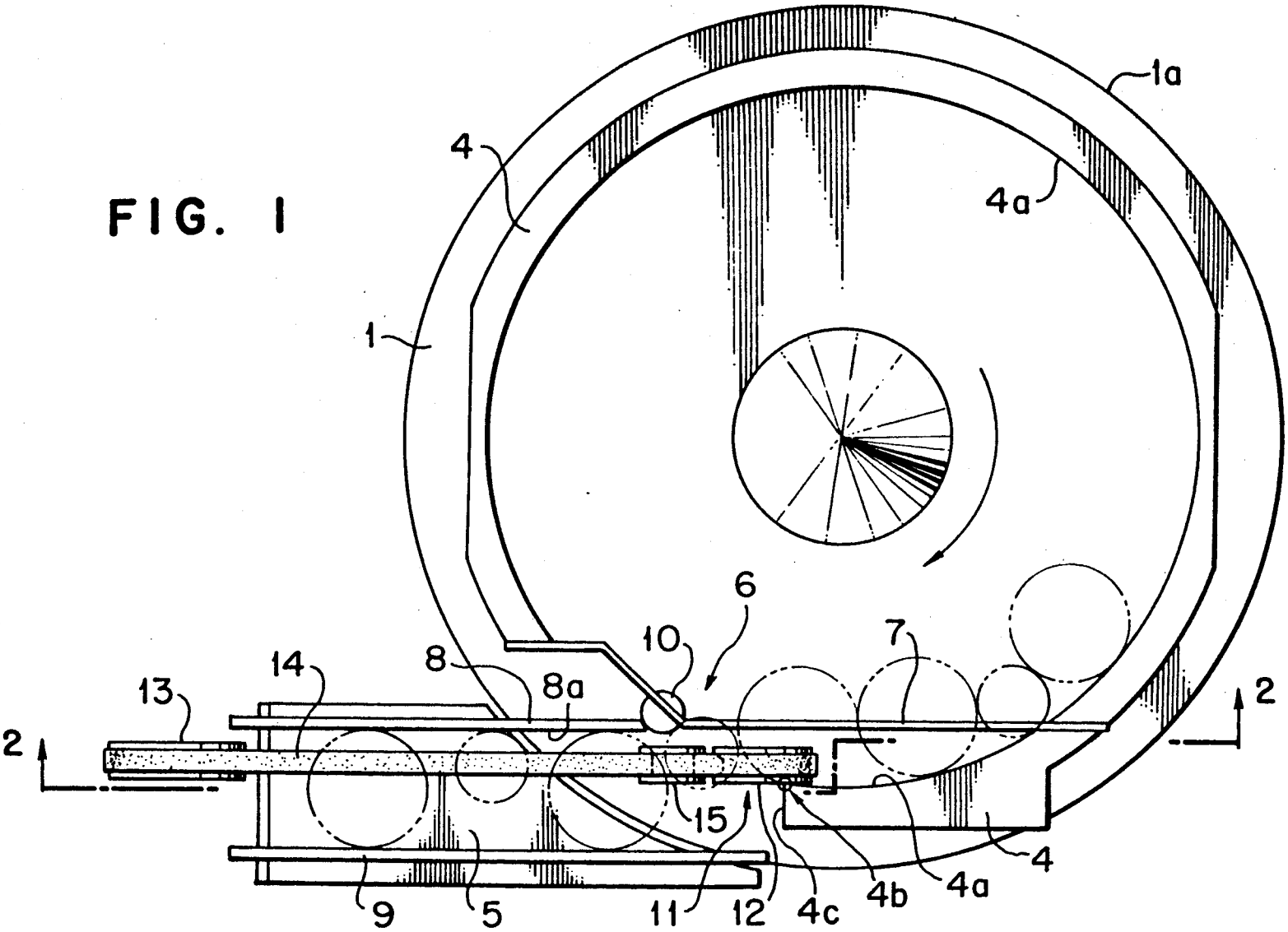
FIG. 1 is a schematic drawing showing a plan view of a coin feed-in apparatus for a coin handling machine which is an embodiment of the present invention.
Figure 2:
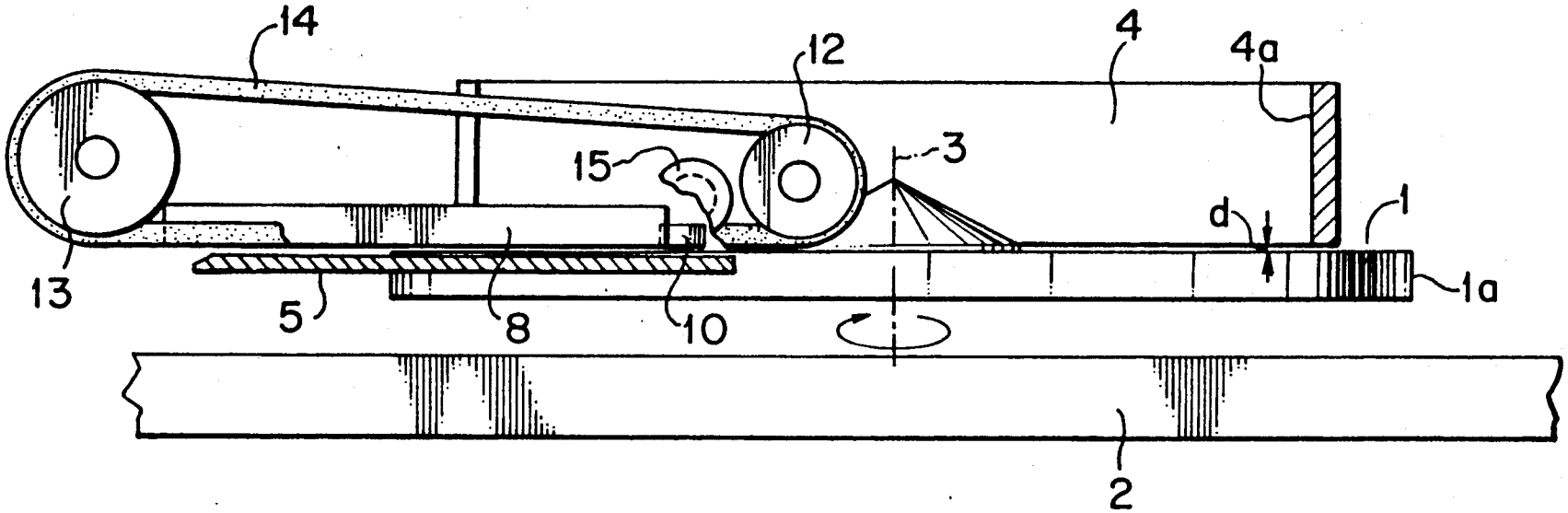
FIG. 2 is a schematic drawing showing a cross-sectional view taken on line X—X of FIG. 1.
Figure 3:
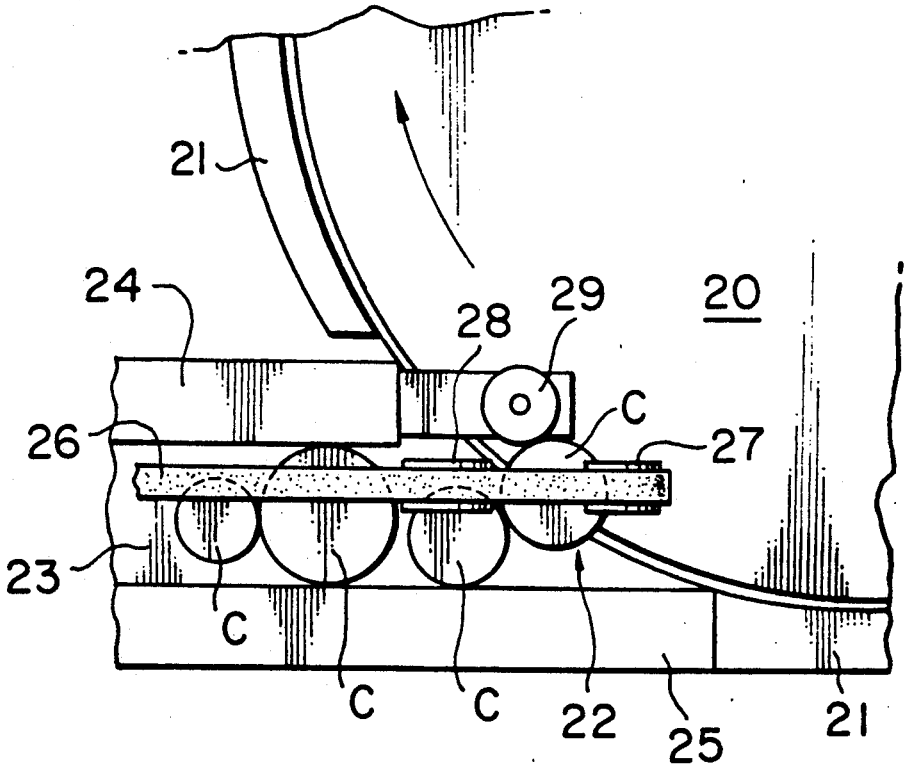
FIG. 3 (PRIOR ART)
FIG. 3 is a schematic drawing showing a plan view of a prior art coin feed-in apparatus for coin handling machine.

Referring to FIGS. 1 and 2, there is provided a rotatable disk 1 for receiving coins deposited through a coin deposit opening (not shown) and the rotatable disk 1 is mounted on a base 2 so as to be rotatable clockwise in FIG. 1 about axis 3.

Above the rotatable disk 1, a guide member 4 is fixed to the body of a coin handling machine by a bracket (not shown) and its inner circumference 4*a* is circular and disposed inside of the periphery 1*a* of the rotatable disk 1. The clearance between the lower face of the guide member 4 and the upper face of the rotatable disk 1 is set smaller than the thickness of the thinnest coins to be handled.

A part of the guide member 4 is formed with an opening 6 communicating with a coin passage 5 and above the rotatable disk 1, a coin separation plate 7 is provided over the entire area of the opening 6. The clearance between the lower face of the coin separation plate 7 and the upper face of the rotatable disk 1 is set slightly greater than the thickness of thickest coins to be handled. For convenience of explanation, the coin separation plate is not shown in FIG. 2.

Accordingly, the coins C received by the rotatable disk 1 are fed toward the opening 6 of the guide member 4 by centrifugal force produced by the rotation of the rotatable disk 1, while being guided by the inner circumference 4*a* of the guide member 4, and separated one by one to be fed to the coin passage 5 one by one.

In the coin passage 5, a pair of first and second guide rails 8, 9 are provided and the first guide rail 8 disposed inside, that is, on the side of the rotatable disk 1, extends to the inside of the periphery 1*a* of the rotatable disk 1. The pair of first and second guide rails 8, 9 is arranged to be parallel with a terminal portion of the inner circumference 4*a* of the guide member 4 upstream with respect to the rotating direction of the rotatable disk 1 and the clearances between the lower face of the first and second guide rails 8, 9, and the upper face of the rotatable disk 1 and the coin passage 5 are set smaller than the thickness of the thinnest coins to be handled. In the vicinity of the upstream end of the first guide rail 8, a rotatable guide roller 10 is provided. A coin feed-out opening 11 is formed between the periphery of the guide roller 10 and the corner 4*b* of the guide member 4 disposed upstream with respect to the rotating direction of the rotatable disk, which is closest to the guide roller 10 and the distance between the periphery of the guide roller 10 and the corner 4*b* of the guide member 4 is set slightly larger than the largest diameter of the coins to be handled, whereby all coins to be handled can be fed to the coin passage 5 through the coin feed-out opening 11. The clearance between the lower face of the guide roller 10 and the upper face of the rotatable disk 1 is set smaller than the thickness of the thinnest coins to be handled.

A transporting belt 14 engaged with a first pulley 12 and a second pulley 13 able to be driven by a drive means (not shown) extends in parallel with the pair of first and second guide rails 8, 9 from upstream of the end 4*c* of the guide member 4 disposed upstream of the opening 6 with respect to the rotation of the rotatable disk 1 to the coin passage 5 and is adapted to transport the coins C fed along the inner circumference 4*a* of the guide member 4 in the direction parallel with the pair of first and second guide rails 8, 9. The distance between a plane containing a tangential line of the periphery of the guide roller 10 parallel with the face of the first guide rail 8 on the side of the coin passage 5 and the corner 4*b* of the guide member 4 is set slightly smaller than the smallest diameter of the coins C to be handled, whereby all coins C being transported by the transporting belt 14 abut against the guide roller 10 without fail. Further, the transporting belt 14 is adapted to transport the coins C along the face of the first guide rail 8 on the side of the coin passage 5.

The upper face of the coin passage 5 is set at the same level as the rotatable disk 1. Although not shown, there are arranged along the the face of the first guide rail 8 on the side of the coin passage 5 a discriminating means for discriminating the denomination and genuineness of the coins, a counting means for counting the value of the deposited coins and a plurality of coin sorting openings, the number of which is equal to that of the denominations of coins C to be handled, for dropping the coins C therethrough and sorting them in accordance with their denominations based upon their diameter.

Further, a press roller 15 is provided downstream of the first pulley 12 and slightly upstream of the guide roller 10 and presses the transporting belt 14 downwardly. As a result, although the first pulley 12 engaged with the transporting belt 14 is disposed sufficiently upstream of the end 4*c* of the guide member 4, the transporting belt 14 can press the coins C downwardly by a force of sufficient magnitude.

In the thus constituted coin feed-in apparatus for the coin handling machine, coins C received on the rotatable disk 1 are fed in the clockwise direction along the inner circumference 4*a* of the guide member 4 by centrifugal force produced by the rotation of the rotatable disk and after being separated one by one by the coin separation plate 7, they are fed one by one to the transporting belt 14. The coins C are further fed by the drive force of the transporting belt 14 and the rotating force of the rotatable disk 1, while being held between the transporting belt 14 and the upper face of the rotatable disk 1, and abut against the guide roller 10. Although the guide roller 10 is rotated to smoothly feed the coins C to the coin passage 5 when the coins abut against the guide roller 10, before the rotation of the guide roller 10 is started, a coin abutting the guide roller 10 is temporarily stopped. Therefore, there is a probability of the following coin C colliding with it. However, in this embodiment, since the first guide rail 8 extends to the inside of the periphery 1*a* of the rotatable disk 1 and the guide roller 10 is disposed upstream of the first guide rail 8, even if the preceding coin C and the following coin C collide with each other, they are fed toward the face 8*a* of the first guide rail 8 on the side of the coin passage 5 by the rotating force of the rotatable disk 1, whereby the deviation of coins C from their desired transporting path can be prevented. As a result, the coin C is further fed along the face 8*a* of the first guide rail 8 on the side of the coin passage 5 by the transporting belt 14, its denomination, genuineness and the like are discriminated by the discriminating means, its value is counted by the counting means and it is sorted by falling through one of the coin sorting openings in accordance with its diameter.

As described above, according to this embodiment, since the inner circumference 4*a* of the guide member 4 is disposed inside of the periphery 1*a* of the rotatable disk 1 and the first guide rail 8 extends to the inside of the periphery 1*a* of the rotatable disk 1 and the guide roller 10 is disposed upstream of the first guide rail 8, even if the coin C is temporarily stopped by the guide roller 10 for preventing the coins from jamming and the following coin C collides with it, the coins C are fed along the first guide rail 8 without fail, whereby it is possible to prevent the discriminating means from erroneously discriminating the coins C, the counting means from erroneously counting the value of coins C and the coin sorting openings from erroneously sorting the coins C, without fail.

As described in detail with reference to the preferred embodiment, according to the present invention, it is possible to provide a coin feed-in apparatus for a coin handling machine capable of preventing erroneous discrimination of coins, erroneous counting of coin value and erroneous sorting of coins.

The present invention has thus been shown and described with reference to the specific embodiment. However, it should be noted that the present invention is in no way limited to the details of the described arrangements but changes and modifications may be made without departing from the scope of the appended claims.

For example, in the above described embodiment, although the transporting belt 14 extends to the upstream portion of the corner 4*b* of the guide member 4, it is sufficient for the transporting belt 14 to extend to at least the upstream portion of the guide roller 10 if the coins C are transported by the transporting roller 14 so as to abut against the guide roller 10 without fail.

Further, in the above described embodiment, although the face 8*a* of the first guide rail 8 on the side of the coin passage 5 is arranged in parallel with the transporting belt 14, it is possible to arrange it in such a manner that the closer to the second pulley 13 it is, the smaller the distance between itself and the transporting belt 14 is, whereby the coins C can be easily fed along the face 8*a* of the first guide rail 8 on the the side of the coin passage 5 by the transporting roller 14.

Moreover, in the above described embodiment, although the height of the upper face of the coin passage 5 is the same as that of the rotatable disk 1, it may be lower than the height of the rotatable disk 1.

What is claimed is:

1. A coin feed-in apparatus for a coin handling machine comprising a rotatable disk for receiving coins, guide means having an opening for guiding the coins, which were received by the rotatable disk and moved toward the periphery of the rotatable disk by centrifugal force produced by the rotation of the rotatable disk, by the inner circumference thereof, a coin passage communicating with said opening and having a pair of first and second guide rail means for guiding coins and transporting belt means for transporting the coins, the coins being transported along the first guide rail means disposed on the side of the rotatable disk of the pair of guide rail means, discriminating means for discriminating the denomination, genuineness and the like of coins, counting means for counting the value of deposited coins, sorting means for sorting the coins in accordance with their denominations, the respective discriminating means, the counting means and the sorting means being arranged along said first guide rail means disposed on the side of the rotatable disk, and guide roller means rotatable and disposed upstream of said first guide rail means, said guide means being arranged so that said inner circumference thereof is positioned inside of the periphery of said rotatable disk and said first guide rail means being arranged so as to extend onto said rotatable disk and said transporting belt means being arranged so as to extend upstream of the end of the guide means disposed upstream of said opening with respect o the rotating direction of the rotatable disk and facing said opening.

2. A coin feed-in apparatus in accordance with claim 1 which further includes a press roller means disposed upstream of said guide roller means for pressing said transporting belt means toward the upper face of said coin passage.

3. A coin feed-in apparatus in accordance with claim 1 wherein a distance between a corner of the end of the guide means disposed upstream of said opening with respect to the rotating direction of the rotatable disk and facing said opening, the corner being closest to the guide roller means, and a plane containing a tangential line of the periphery of said guide roller means parallel with a face of the first guide rail means on the side of said coin passage is set smaller than the smallest diameter of coins to be handled.

4. A coin feed-in apparatus in accordance with claim 1 wherein a distance between a corner of the end of the guide means disposed upstream of said opening with respect to the rotating direction of the rotatable disk and facing said opening, the corner being closest to the guide roller means, and a plane containing a tangential line of the periphery of said guide roller means parallel with a face of the first guide rail means on the side of said coin passage is set smaller than the smallest diameter of coins to be handled.

5. A coin feed-in apparatus in accordance with claim 2 wherein a distance between a corner of the end of the guide means disposed upstream of said opening with respect to the rotating direction of the rotatable disk and facing said opening, the corner being closest to the guide roller means, and a plane containing a tangential line of the periphery of said guide roller means parallel with a face of the first guide rail means on the side of said coin passage is set smaller than the smallest diameter of coins to be handled.

* * * * *